US005205357A

United States Patent [19]

Terral

[11] Patent Number: 5,205,357

[45] Date of Patent: Apr. 27, 1993

[54] LATCHING DEVICE

[76] Inventor: Ben D. Terral, 118 Timberwilde, Huntsville, Tex. 77340

[21] Appl. No.: 550,338

[22] Filed: Jul. 9, 1990

Related U.S. Application Data

[60] Continuation-in-part of Ser. No. 279,995, Dec. 5, 1988, Pat. No. 4,940,089, which is a division of Ser. No. 64,872, Jun. 19, 1987, Pat. No. 4,813,730.

[51] Int. Cl.[5] ..... E21B 23/03

[52] U.S. Cl. ..... 166/117.5; 166/386

[58] Field of Search ..... 166/117.5, 117, 117.6, 166/162, 214, 215, 216, 217, 386; 294/86.24, 86.25, 86.33

[56] References Cited

U.S. PATENT DOCUMENTS

| | | | |
|---|---|---|---|
| 3,207,224 | 9/1965 | Schramm | 166/217 |
| 3,827,493 | 8/1974 | Terral | 166/215 |
| 3,863,961 | 2/1975 | Dinning | 166/215 |
| 3,874,448 | 4/1975 | McGowen, Jr. et al. | 166/215 |
| 4,375,237 | 3/1983 | Churchman | 166/117.5 |
| 4,538,681 | 9/1985 | Johnston | 166/117.6 |
| 4,540,048 | 9/1985 | Gazda | 166/214 |

*Primary Examiner*—Terry Lee Melius
*Attorney, Agent, or Firm*—James L. Jackson

[57] ABSTRACT

A latching device for locking and removal of a flow control device from a mandrel receiver comprises a cylindrical stem, a locking sleeve slidably mounted upon the stem, an annular locking ring mounted for a limited axial movement along the lower portion of the locking sleeve and a compression spring. The annular locking ring has upper and lower beveled surfaces which are complementary to beveled surfaces of a mandrel receiver.

The locking ring is loosely received about a circular back-up surface formed by the lower portion of the locking sleeve and is pivotal to an inclined position relative to the locking sleeve to thus prevent the binding that typically causes bending of the flow control device. The compression spring forms a locking coil at its upper end which is of less dimension than its other coils. The locking coil is received within a locking groove in the locking sleeve thus locking the spring to the sleeve.

6 Claims, 3 Drawing Sheets

LATCHING DEVICE

FIELD OF THE INVENTION

This is a continuation-in-part of application Ser. No. 07/279,995 filed on Dec. 5, 1988 by Ben David Terral and entitled Latching Device now U.S. Pat. No. 4,940,089, issued on Jul. 10, 1990, which is a division of application Ser. No. 07/064,872 filed on Jun. 19, 1987 and entitled "Retrieval Device for a Well Tool", now U.S. Pat. No. 4,813,730 issued on Mar. 21, 1989.

The present invention relates to latches for retrievable flow control devices used in oil and gas industries, and more specifically to latches which are utilized to secure or to remove a flow control valve from a mandrel receiver at a subterranean location.

The use of various types latches for such purposes is well known in the oil and gas industries. However, many latches which are currently utilized in the field suffer from a major drawback: the locking ring, in many instances, "wedges" against the locking shoulder of a mandrel due to interference between the locking ring and the support and guiding surfaces that permit its locking and unlocking movement. This wedging or binding activity can lead to bending and metal damage of the flow control device or the mandrel receiver, and as a result, to inability of the latching device to secure positioning of the valve in the mandrel receiver.

Another problem which is often encountered in the oil and gas industries is inability of a retrieval tool to retrieve a valve which is locked downhole. Under these circumstances, all pulling means are usually carried up to the surface, while the valve has only one direction which it can be moved—upward. The valve cannot be retrieved by driving it down through the mandrel and at the present time, the tubing is usually pulled to the surface so that the valve, in such emergency situations, can be retrieved. While such procedure could be acceptable for production on land, no similar benefit could be obtained at an offshore location. A drilling rig will have to be moved away from that particular location and the well will stay dormant until a next workover program is effected which can take as long as five to six years from the time the well is immobilized. This causes not only loss of some pieces of equipment, but what is more important, loss of well production.

SUMMARY OF THE INVENTION

The present invention is designed to solve both of the problems in a simple and straightforward manner. A latching device, in accordance with the present invention, is provided with a cylindrical body, a locking sleeve mounted in surrounding and slidable relationship on the body, a locking ring and a compressible spring which normally urges the locking ring downward so that it rests on top of the latch sub which is attached to a flow control device, such as a valve. To prevent wedging of the locking ring against the locking shoulder of the mandrel receiver, the looking ring comprises upper and lower beveled surfaces which are complementary to the beveled surfaces of the locking shoulder of the mandrel receiver, so that the surfaces can meet at a common plane when the latching device is driven into the mandrel receiver or pulled up to the surface.

To facilitate retrieval of a flow control device, such as a valve, when all retrieval means have been carried out to the surface or the well is immobilized, the present invention provides for the use of a cylindrical latching sub having a central opening, the internal wall of which is provided with an internal recess above the means of attachment of the latch sub to a latching device, for example. A retrieval tool comprises an upper body and a lower nose portion, and a compressible C-shaped ring is mounted on the nose portion, so that it compresses while the nose portion is being driven into the central opening of the cylindrical latch sub and releases when it reaches the internal recess, thereby effectively locking the retrieval tool within the latching device. The latch sub has also means for secure attachment of the latch sub to the flow control device to be retrieved.

Further, the locking ring is supported in non-interference fitting relation with the locking sleeve and is thus pivotal to an inclined relation with the longitudinal axis of the locking sleeve to prevent the binding that could otherwise bend the flow control device. Even further, the spring that activates the locking ring is captive to the locking sleeve and cannot fall into the well before the fishing neck is retrieved from the well.

It is therefore an object of the present invention to provide a latching device for positioning and removal of a flow control device from a tubular receiver.

It is also an object of this invention to provide a locking ring which will not bind or wedge during its movement past the locking lug of the well tool thus minimizing the possibility of binding the tool.

It is a further object of the present invention to provide a latching device with means which prevent wedging of the locking means of the latching device against locking shoulder of the tubular receiver.

It is a further object of the present invention to provide a retrieval tool for retrieval of a flow control device from a tubular receiver when the flow control device is locked downhole and all pulling means have been carried up to the surface. It is a further object of the present invention to secure the latch activating spring to the locking sleeve to ensure that the spring will not fall into the well bore during retrieval of the fishing neck.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 1:
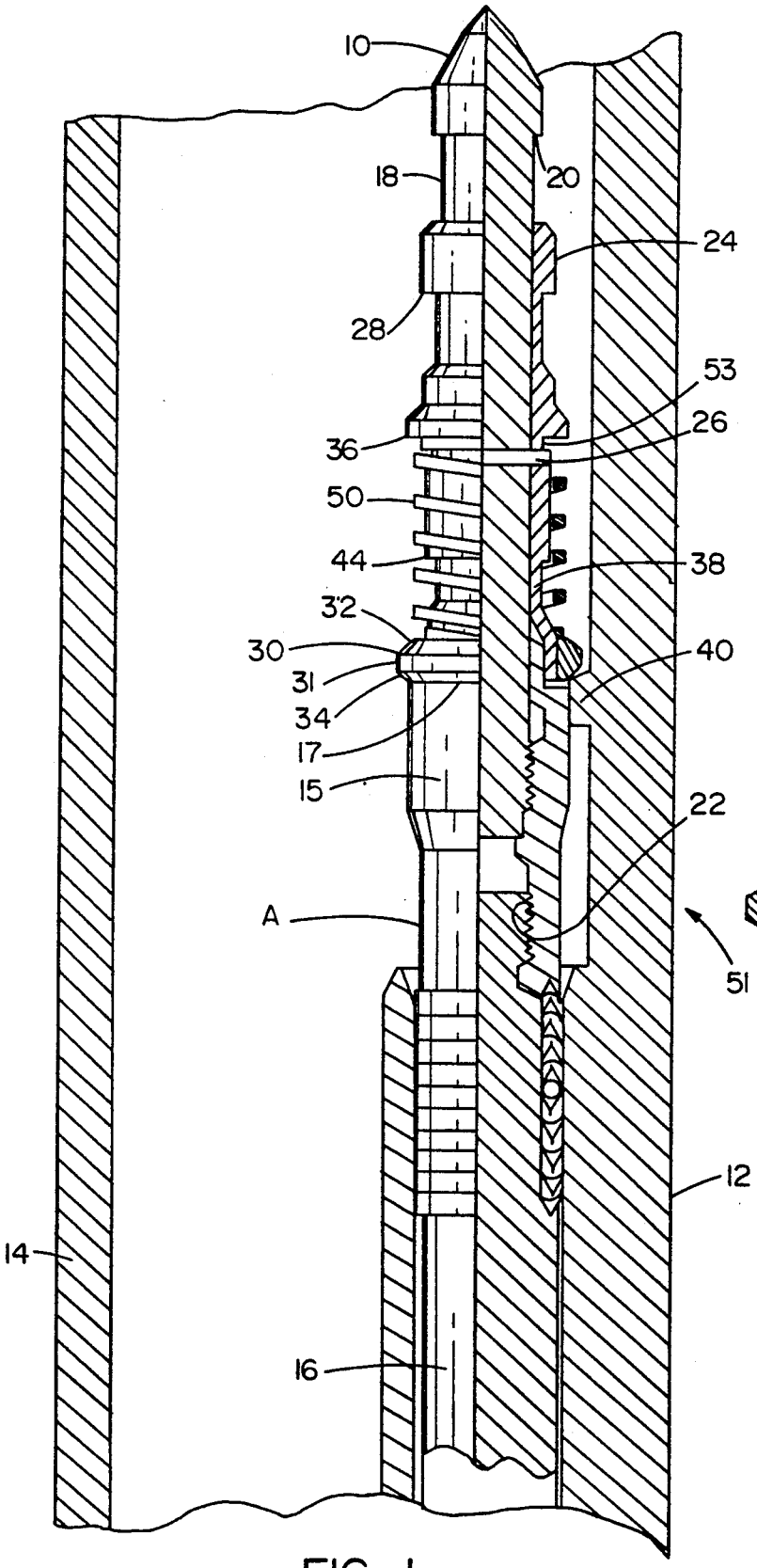

FIG. 1 is an elevational view, partially in cross-section showing the locking ring meeting the locking shoulder of the tubular receiver by a complementary beveled surface and illustrating the locked relation of the latch control spring.

Figure 2:
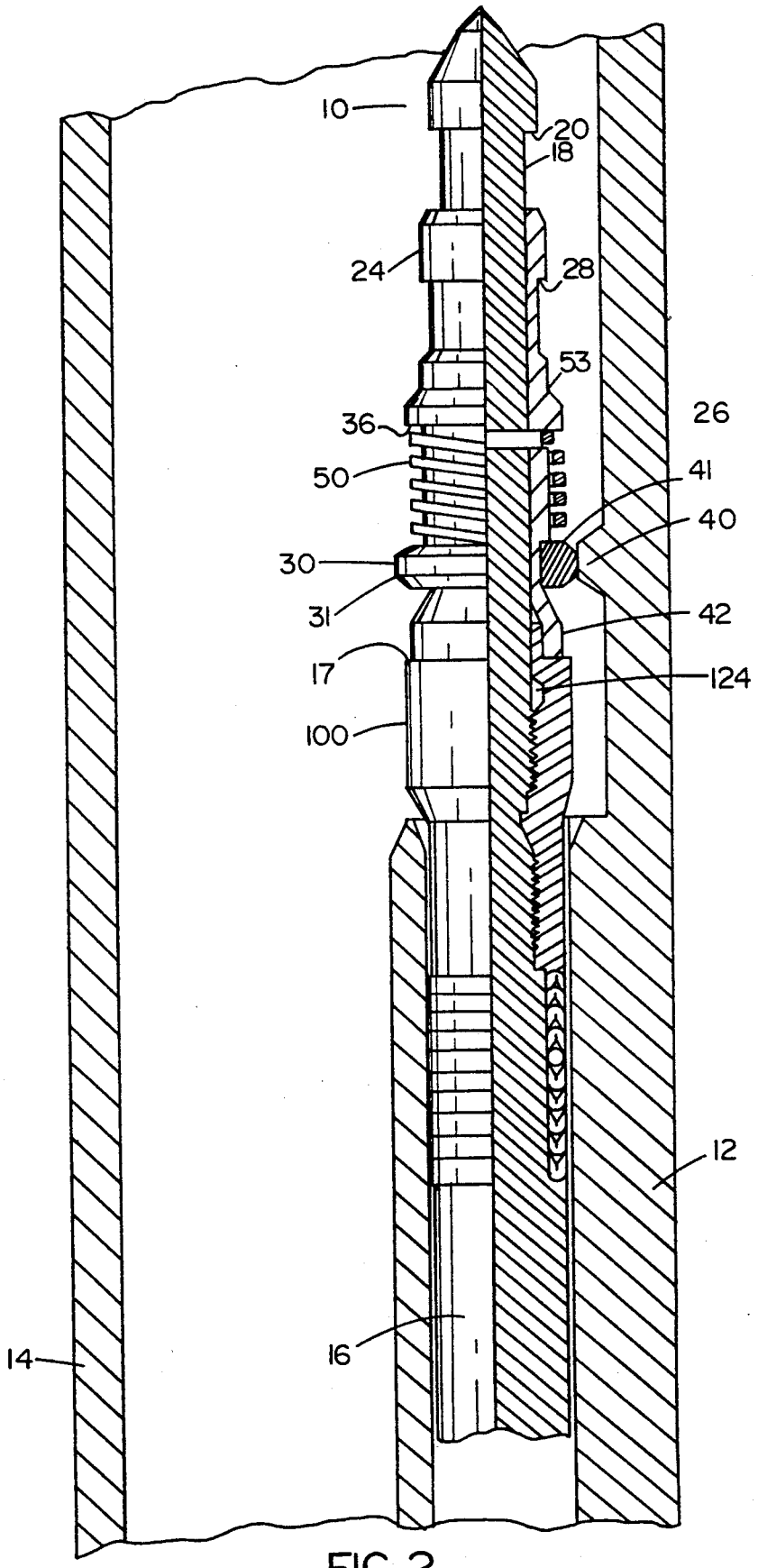

FIG. 2 is an elevational view, partially in cross-section, showing the position of the locking ring, when it meets by its flat surface a respective flat surface of the looking shoulder of a tubular receiver.

Figure 3:
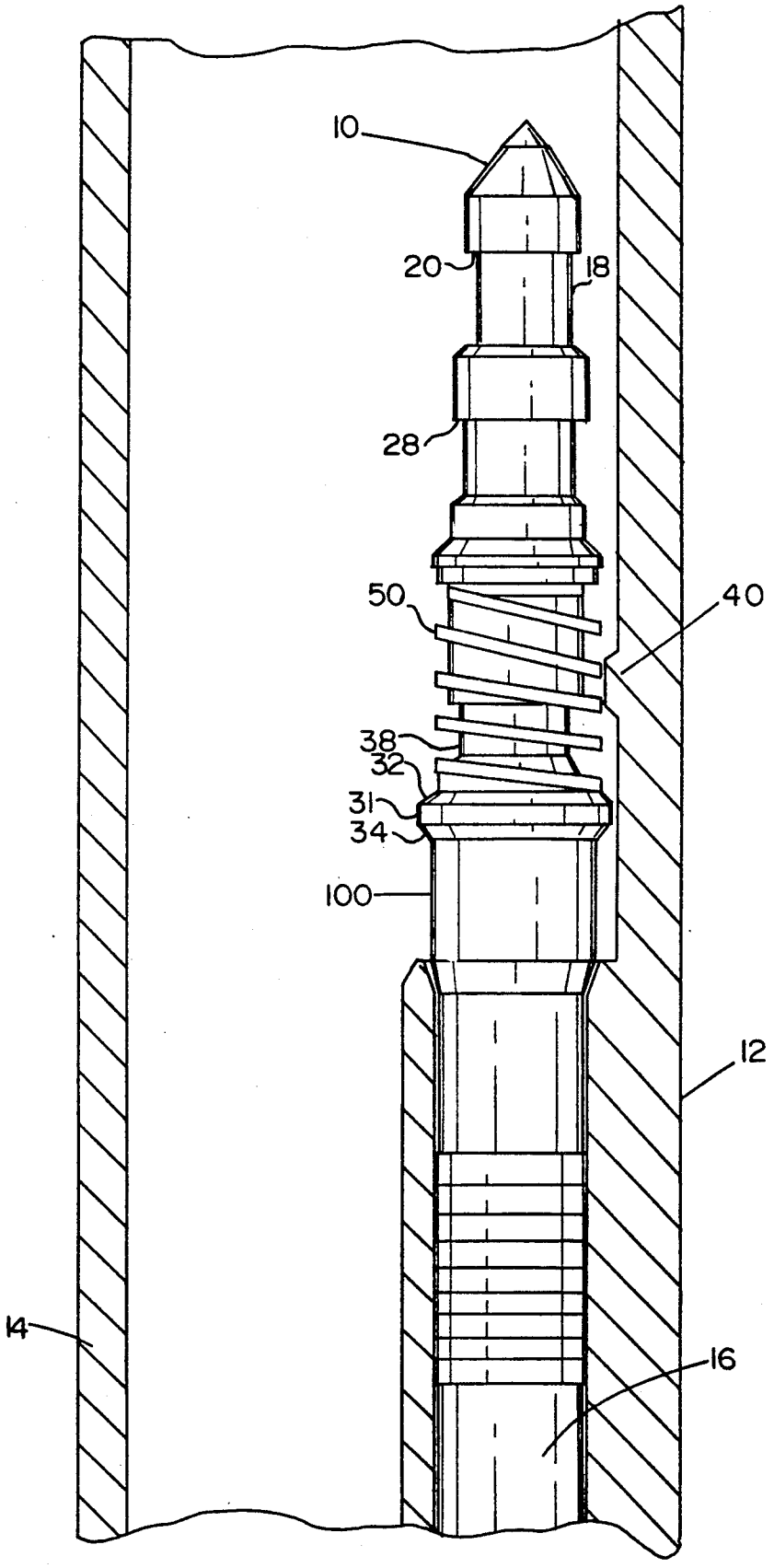

FIG. 3 is an elevational, partially cross-sectional view, showing the position of the locking ring and of the released spring when the locking ring passes the locking shoulder of the tubular receiver.

Figure 4:
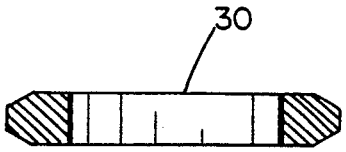

FIG. 4 is an elevational, partially cross-sectional view of a locking ring in accordance with the present invention.

Figure 5:
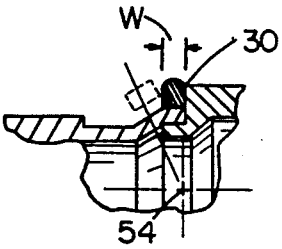

FIG. 5 is a fragmentary sectional view illustrating the pivotal relationship of the locking ring or latch ring to the locking sleeve.

DETAILED DESCRIPTION OF THE PREFERRED EMBODIMENT

Referring now to the drawings, numeral 10 designates the latch of the present invention adapted for use in a side pocket 12 of mandrel 14 in which a flow control device 16, such as a valve, is mounted.

The latch 10 comprises a generally cylindrical body 18 having a shoulder 20 at its upper portion for engagement with a running tool (not shown) designed for positioning the flow control device 16 in the side pocket 12. The lower portion of the latch 10 is provided with threads 22 for threaded engagement with the flow control device 16.

A locking sleeve means 24 is slidably mounted on the cylindrical body 18, and a shear pin means 26 serves to temporarily secure the locking sleeve 24 in its lowermost position in relation to the ±low control device 16.

Retrieval of the latch 10 and the flow control device 16 can be achieved through the use of a conventional retrieval tool (not shown) which will engage an upper shoulder 28 at the upper portion of the locking sleeve 24 and, by application of an upwardly directed force, will cause shearing of the pin 26 and movement of the slidable locking sleeve 24 upward in relation to the cylindrical body 18, thus allowing retrieval of the latch 10 and the flow control device 16 which is threadably engaged with the latch 10.

An annular locking ring means 30 is slidably mounted on the sleeve 24 and is provided with upper and lower beveled surfaces, designated by numerals 32 and 34, respectively. The angle of the bevel is designed to be complementary and to substantially match an angle on a latch lug 40 of the side pocket 12. The advantages of such design are such that the locking ring can pivot to an inclined relation with the longitudinal axis of the locking sleeve so that there is no "wedging" effect of the ring 30 against the latch lug 40 when a downward force is applied to the flow control device 16, pushing it into the side pocket 12. A progressive downward movement of the flow control device 16, as was noted above, can even cause bending of the flow control device 16 which is, for example, a valve, when the angles of bevel of the locking ring 30 and the latch lug 40 are mismatched or when there is interference between the latching and the locking sleeve that prevents the latch ring from rotating relative to the locking sleeve, as is the case with those currently used in the field latching devices.

When such devices are used and the bevels of the locking ring and of the latch lug do not match, there is one point of contact between a lower bevel surface of the locking ring and an upper bevel surface of the latch lug. The latch lug "digs" into the locking ring, causing wedging and even occasional bending of the valve which is being pushed downwardly into a side pocket of a mandrel. In this case, the force which acts upon the beveled surfaces is almost perpendicular to the vertical movement of the latch.

In the case of the complementary, matching angle bevels, in accordance with the present invention, the force acting upon the bevel surfaces is at an acute angle to the vertical. The direction of force acting upon the bevel surfaces in accordance with the present invention is shown by arrow 51 in FIG. 1 of the drawings. The point of contact of the beveled surfaces moves towards the center of the annular locking ring 30, causing the complementary beveled surfaces to meet at a common plane. Such advantages are not achieved by any other currently used latch known to the applicant. The ratio of the locking ring width shown at "W" in FIG. 5, the inside diameter of the locking ring and the outside diameter of the backup surface defined by the head 42 are such that the locking ring is permitted to rotate above the back-up surface without interference. It is this interference that can cause the locking ring to fail to move upward into the locking mode. Failure of the locking ring to move upwardly causes the valve to become bent at "A" as shown in FIG. 1. With reference to FIG. 5, the locking ring is shown to be capable of pivoting to an inclined position relative to the longitudinal axis of the locking sleeve. Essentially this pivoting action of the locking ring takes place about a pivot point 54 from the full line position through the broken line position as shown in FIG. 5. Since the internal diameter of the latch ring and the outer diameter of the back-up surface permit a rather loose non-intereference fit between these surfaces, the locking ring cannot bind the locking sleeve and allow the development of sufficient force that will cause bending of the valve.

A spring means 50, preferably of rectangular cross-sectional configuration as shown but capable of being of circular cross-sectional configuration if desired, is mounted circumferentially about the outside lower portion of the slidable locking sleeve 24. The spring 36 acts against an intermediate shoulder 36 and the annular locking ring 30. The spring 50 serves to retain the position of the locking ring 30 in relation to the flow control device 16, urging the locking ring 30 to rest atop the upper edge 17 of the flow latch sub 15. The small diameter upper coil 52 of the spring is received within the groove 53 and establishes a locked relationship between the spring and the locking sleeve. Consequently, in the event the fishing neck and latching sleeve are withdrawn from the well, the spring will remain securely locked to the latching sleeve and will not become separated and fall into the well bore.

FIG. 2 shows a progressive movement of the latch 10 downwardly and the locking ring 30 contacting a flat internal surface 41 of the latch lug 40 by its corresponding flat surface 31.

The spring 50 is compressed by the locking ring 30 which forces it upwardly. At the same time, the locking ring 30, having an internal diameter greater than an outside diameter of the body 18 and of an enlarged diameter head 42 of the locking sleeve 24, is forced sideways, laterally, to a limited degree, by the flat surface 41 of the latch lug acting upon the flat surface 31 of the locking ring 30.

The limited degree of the lateral, sideways movement of the locking ring 30 is made possible by the provision of a reduced diameter portion 38 on the sleeve 24, the portion 38 being formed above the enlarged diameter head 42 of the lower portion of the locking sleeve 24.

A lower shoulder 44 is formed above the reduced diameter portion 38 and, being of a greater diameter than the internal diameter of the locking ring 30, limits its upper movement along the locking sleeve 24 when the locking ring 30 is engaged by the latch lock 40 and the spring 50 is compressed. The vertical distance of the reduced diameter portion 38 is at least as great as the thickness of the locking ring 30 to prevent any wedging effect between the locking ring 30 and the latch lug 40. Still, the outside diameter of the locking ring 30 is greater than the diameter of the shoulder 44, thereby allowing the shoulder 44 to effortlessly pass the latch lug 40, after the locking ring has passed the latch lug 40 as will be described below.

As shown in FIG. 3, progressive downward movement of the flow control device 16 into the side pocket 12 results in positioning of the locking ring 30 below the latch lug 40. The compressed spring 50 releases, forcing the locking ring 30 downward, to its original position atop the latch sub 15, thereby locking the latch 10 and the flow control device 16 in the side pocket 12 of mandrel 14. The running tool (not shown) is then disengaged from shoulder 20 leaving the flow control device 16 inside the side pocket 12. The operation of the shoulder 44 is also described in U.S. Pat. No. 3,827,493, issued on Aug. 6, 1974, the disclosure of which is incorporated herewith by reference.

Retrieval of the flow control device, under normal conditions, can be accomplished by conventional methods and tools, by engaging the upper shoulder 28, shearing the shear pin 26 and pulling the locking sleeve 24 upwardly. While the sleeve 24 slides upwardly on the body 18, the spring 50 being in captive locked relation with the sleeve, also moves upwardly and releases, to some degree, leaving the locking ring 30 seated above the edge 17 of the flow control device 16 and below the enlarged diameter head 42 of the locking sleeve 24.

The lower beveled surface of the latch lug 40 is contacted by the complementary angled upper surface 32 of the locking ring 30, which then slides upward and, upon contact of the flat surfaces 41 and 31 of the latch lug 40 and the locking ring 30, respectively, moves laterally towards the body 18 to pass the latch lug 40 and allow retrieval of the flow control device 22 from its position in the side pocket 12 of mandrel 14.

The foregoing disclosure and description of the invention is illustrative and explanatory thereof, and various changes may be made within the scope of the appended claims without departing form the spirit of the invention.

What is claimed:

1. A latching device for selectively locking and retrieving a well tool from a tubular receiver having an internally projecting locking shoulder with upper and lower angularly beveled surfaces, the latching device comprising:

means for attaching the latching device to an upper portion of the well tool;

a substantially cylindrical body provided with means to facilitate installation of the latching device within the tubular receiver;

a locking sleeve mounted in axially slidable, surrounding relationship on the cylindrical body, said locking sleeve having an upper shoulder to facilitate retrieval of the latching device from the tubular receiver, said locking sleeve forming an external diameter back-up surface and defining a longitudinal axis and defining a reduced diameter portion above said external diameter back-up surface, said locking sleeve further defining a reduced diameter annular spring retainer recess located below said upper shoulder;

an annular locking ring movably mounted on the locking sleeve means for effectively locking the latching device in the tubular receiver, the locking ring having upper and lower angularly beveled surfaces which are angled to be complementary to the beveled surfaces of the locking shoulder of the tubular receiver and which contact the locking shoulder during locking and retrieving of the well tool, said locking ring defining an internal diameter surface being receivable in non-interference pivotal relation with said external diameter back-up surface permitting said locking ring to pivot to angulated relation with respect to said longitudinal axis;

a compression spring compressively arranged to urge the locking ring toward the well tool, said spring being compressed by the locking ring when the locking ring passes the locking shoulder of the tubular receiver and being released after passing of the locking shoulder by the locking ring, said compression spring having an upper coil of smaller dimension as compared to other coils thereof, said upper coil being received within said spring retainer recess thus retaining said compression spring in assembly with said locking sleeve after release of said compression spring.

2. The latching device of claim 1, wherein said annular spring retainer groove and said upper coil of said compression spring are of corresponding rectangular cross-sectional configuration, said compression spring acting against said locking ring at its lower end and acting against a shoulder formed on said locking sleeve at its upper end.

3. The latching device of claim 1, wherein said upper coil of said compression spring is locked in captive relation within said spring retainer recess of locking sleeve.

4. A latching device for selectively locking and retrieving a well tool from a tubular receiver having an internally projecting locking shoulder with an upper and lower angularly beveled surfaces, the latching device comprising:

a substantially cylindrical body having an enlarged upper portion and a lower portion configured for attachment of the body to an upper portion of the well tool;

a locking sleeve mounted circumferentially about the cylindrical body and adapted for slidable axial movement being limited by the upper enlarged portion of the cylindrical body and an upper end of the well tool, said locking sleeve having an upper shoulder to facilitate retrieval of the latching device from the tubular receiver, said locking sleeve further having an intermediate shoulder, a lower shoulder and an enlarged diameter lower portion, said enlarged diameter lower portion forming a cylindrical back-up surface, said locking sleeve further defining a reduced diameter portion located below said lower shoulder, said locking sleeve further defining an annular spring retainer recess located between said intermediate and lower shoulders;

an annular locking ring mounted on said locking sleeve, the internal diameter of the locking ring being greater than the diameter of said cylindrical back-up surface and being adapted for axial movement in relation to the cylindrical body and the locking sleeve and having a non-interference relation with said cylindrical back-up surface permitting pivoting of sad locking ring to an angulated relation with said locking sleeve, said locking ring having upper and lower angularly beveled surfaces which are angled to be complementary to the beveled surfaces of the locking shoulder of the tubular receiver and which contact the locking shoulder of the tubular receiver during locking and retrieving of the well tool; and a compression spring being compressively arranged to urge said locking ring toward said well tool, said spring being compressed by the locking ring when the locking ring passes the locking shoulder of the tubular receiver and being released after passing of the locking shoulder by the locking ring, said compression spring being mounted circumferentially about the locking sleeve below the intermediate shoulder formed on the locking sleeve, and defining an upper coil of smaller dimension than other coils thereof and being received in retained relation within said spring retainer recess to thus retain said compression spring in assembly with said locking sleeve.

5. The device of claim 4, wherein said compression spring acts against the locking ring at its lower end and acts against a shoulder formed on the locking sleeve at its upper end.

6. The device of claim 4, wherein said upper coil of said compression spring is locked in captive relation within said spring retainer recess of said locking sleeve means.

* * * * *